US011519242B2

(12) United States Patent
Dharne et al.

(10) Patent No.: US 11,519,242 B2
(45) Date of Patent: Dec. 6, 2022

(54) TELESCOPIC STAGE CEMENTER PACKER

(71) Applicant: Halliburton Energy Services, Inc., Houston, TX (US)

(72) Inventors: Avinash Gopal Dharne, Houston, TX (US); Lonnie Carl Helms, Humble, TX (US); Ishwar Dilip Patil, Conroe, TX (US); Frank Vinicio Acosta, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 54 days.

(21) Appl. No.: 17/245,308

(22) Filed: Apr. 30, 2021

(65) Prior Publication Data

US 2022/0349273 A1 Nov. 3, 2022

(51) Int. Cl.
*E21B 33/14* (2006.01)

(52) U.S. Cl.
CPC ..... *E21B 33/146* (2013.01)

(58) Field of Classification Search
CPC ..... E21B 33/146
See application file for complete search history.

(56) References Cited

U.S. PATENT DOCUMENTS 3,768,562 A * 10/1973 Baker ..... E21B 34/14 251/74
3,789,926 A * 2/1974 Henley ..... E21B 34/14 166/318
3,948,322 A 4/1976 Baker
4,487,263 A * 12/1984 Jani ..... E21B 33/16 166/194
4,669,541 A * 6/1987 Bissonnette ..... E21B 34/14 166/154
4,674,569 A 6/1987 Revils et al.
5,024,273 A 6/1991 Coone et al.
5,279,370 A * 1/1994 Brandell ..... E21B 33/128 166/184
5,411,095 A * 5/1995 Ehlinger ..... E21B 33/146 166/317
5,443,124 A * 8/1995 Wood ..... E21B 34/103 166/374

(Continued)

FOREIGN PATENT DOCUMENTS

EP 1262629 A1 12/2002

OTHER PUBLICATIONS

International Search Report and Written Opinion dated Jun. 20, 2022, issued in PCT Application No. PCT/US2022/020696.

(Continued)

*Primary Examiner* — Shane Bomar
(74) *Attorney, Agent, or Firm* — McAfee & Taft

(57) ABSTRACT

A stage cementing tool has a mandrel defining a central flow passage and a plurality of cementing passages in a wall thereof. A packer is disposed about the mandrel. A closing sleeve is detachably connected to and movable relative to the mandrel. An opening sleeve defining a plurality of fully open cement flow ports therethrough is telescopically movable relative to the closing sleeve and movable relative to the mandrel. The opening sleeve is movable to move the packer to the set position, and thereafter movable to open a cement flow path between the central flow passage and an annulus defined by the stage cementing tool and the wellbore.

19 Claims, 5 Drawing Sheets

(56) References Cited

U.S. PATENT DOCUMENTS

| | | | | |
|---|---|---|---|---|
| 5,647,434 | A | 7/1997 | Sullaway et al. | |
| 5,765,641 | A | 6/1998 | Shy et al. | |
| 6,026,903 | A | 2/2000 | Shy et al. | |
| 6,244,342 | B1 | 6/2001 | Sullaway et al. | |
| 6,425,442 | B1 | 7/2002 | Latiolais, Jr. et al. | |
| 6,796,377 | B2 | 9/2004 | Butterfield, Jr. et al. | |
| 6,802,373 | B2 | 10/2004 | Dillenbeck et al. | |
| 7,237,611 | B2 * | 7/2007 | Vincent | E21B 34/06 166/374 |
| 7,857,052 | B2 | 12/2010 | Giroux et al. | |
| 7,866,402 | B2 * | 1/2011 | Williamson, Jr. | E21B 34/10 166/374 |
| 8,215,404 | B2 | 7/2012 | Makowiecki et al. | |
| 8,616,276 | B2 | 12/2013 | Tips et al. | |
| 8,646,537 | B2 | 2/2014 | Tips et al. | |
| 8,720,561 | B2 | 5/2014 | Zhou | |
| 9,010,442 | B2 | 4/2015 | Streich et al. | |
| 9,121,255 | B2 * | 9/2015 | Themig | E21B 34/102 |
| 9,291,007 | B2 | 3/2016 | Darbe et al. | |
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,816,351 | B2 | 11/2017 | Lirette et al. | |
| 9,920,620 | B2 | 3/2018 | Murphree et al. | |
| 10,024,150 | B2 | 7/2018 | Andreychuk et al. | |
| 10,316,619 | B2 | 6/2019 | De Oliveira et al. | |
| 10,358,914 | B2 | 7/2019 | Roberson et al. | |
| 10,557,329 | B2 | 2/2020 | Gao et al. | |
| 11,280,157 | B2 | 3/2022 | Acosta et al. | |
| 11,293,253 | B2 | 4/2022 | Santoso et al. | |
| 2006/0207765 | A1 | 9/2006 | Hofman | |
| 2007/0261850 | A1 * | 11/2007 | Giroux | E21B 33/14 166/291 |
| 2008/0251253 | A1 * | 10/2008 | Lumbye | E21B 33/16 166/317 |
| 2009/0071655 | A1 * | 3/2009 | Fay | E21B 34/14 166/332.1 |
| 2009/0151960 | A1 | 6/2009 | Rogers et al. | |
| 2010/0051276 | A1 | 3/2010 | Rogers et al. | |
| 2010/0163253 | A1 * | 7/2010 | Caldwell | E21B 34/12 166/387 |
| 2013/0048290 | A1 | 2/2013 | Howell et al. | |
| 2013/0233570 | A1 * | 9/2013 | Acosta | E21B 33/128 166/383 |
| 2013/0233572 | A1 | 9/2013 | Helms et al. | |
| 2015/0027706 | A1 * | 1/2015 | Symms | E21B 34/066 166/185 |
| 2015/0184489 | A1 | 7/2015 | Resweber | |
| 2017/0145784 | A1 * | 5/2017 | Zhou | E21B 33/146 |
| 2019/0017366 | A1 | 1/2019 | Alaas et al. | |
| 2019/0249549 | A1 | 8/2019 | Fripp et al. | |
| 2020/0270967 | A1 * | 8/2020 | Fong | E21B 33/1293 |
| 2021/0010345 | A1 | 1/2021 | Acosta et al. | |

OTHER PUBLICATIONS

International Search Report and Written Opinion dated Apr. 5, 2021, issued in PCT Application No. PCT/US2020/053694.

Halliburton Brochure, "Cementing ES II Stage Cementer," Feb. 2009.

Halliburton Brochure, "Fidelis Stage Cementer," Sep. 2013.

Halliburton Catalog titled "Casing Equipment" (2015), entire catalog.

* cited by examiner

TELESCOPIC STAGE CEMENTER PACKER

BACKGROUND

When completing a subterranean well, casing is typically inserted into the wellbore and secured in place by injecting cement within the casing. The cement is forced through a lower end of the casing and into an annulus between the casing and wellbore wall. A displacement fluid is pumped into the casing above a plug to urge the plug downward through the casing to extrude the cement from the casing outlet and back up into the annulus. In some instances, it is impossible or impractical to cement the entire well.

To overcome the problems of a single stage cement process, the casing string is cemented in sections, which is known as a staging process. Staging involves placing cement staging tools integral within the casing string. The staging tools allow cement to flow downward therethrough to a lower section of the casing string during primary or first stage cementing operations. When the portion of the casing string below the particular staging tool is cemented to the well, the staging tool will divert cement into the surrounding annulus where the cement can flow upwards in the annulus.

DESCRIPTION OF AN EMBODIMENT

Figure 1:
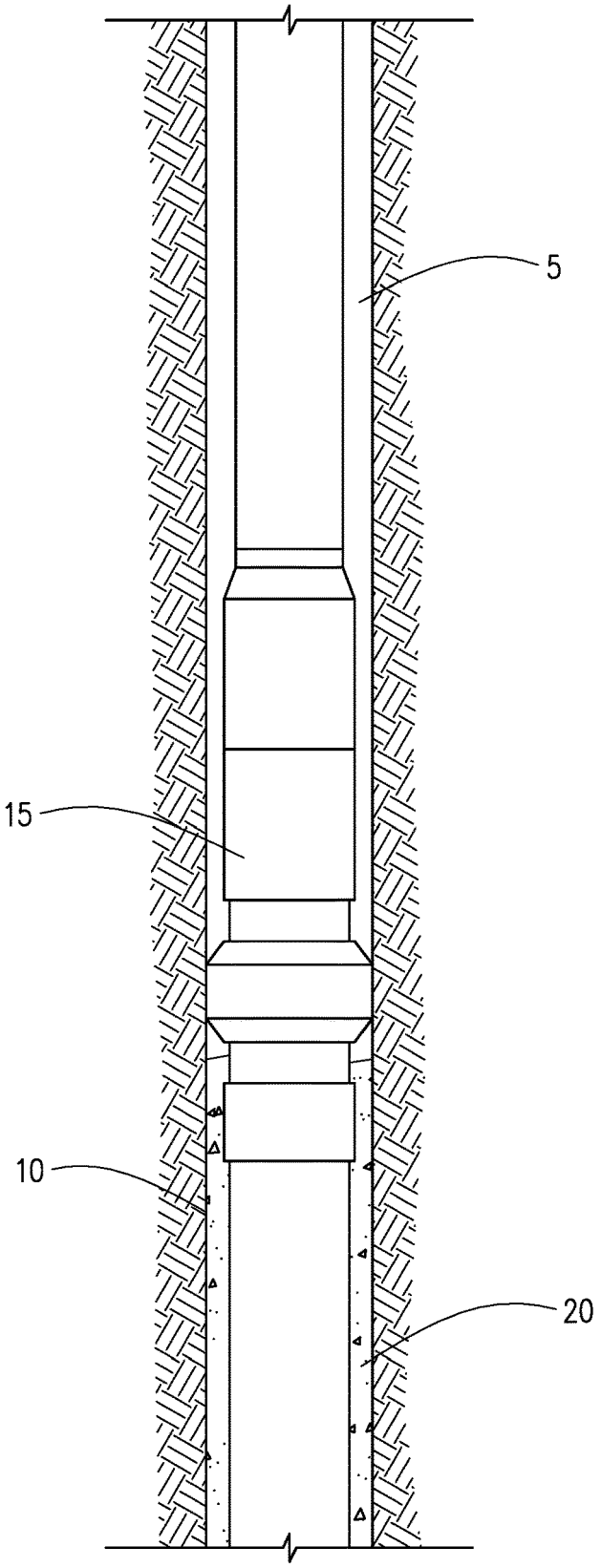
FIG. 1 is a schematic showing a stage cementing tool in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis.

FIG. 1 schematically discloses a stage cementing tool 15 disposed in a wellbore 10. Stage cementing tool 15 is connected in a casing 5. FIG. 1 also shows cement below stage cementing tool 15 which will have occurred in a prior cementing stage. An annulus 25 is defined by and between casing 5 and wellbore 10 and thus between stage cementing tool 15 and wellbore 10. Stage cementing tool 15 has a run-in position, or first position 30, shown in FIG. 2, a second, or set position 32 shown in FIG. 3, a third, or cementing position 34 shown in FIG. 4 and a fourth, or completed position 36 shown in FIG. 5. As is evident from the drawings, in the cementing and completed positions the tool 15 remains in the set position. When referred to herein as the set position, it is that position when the packer described herein is set, but prior to the time the stage cementing tool 15 moves to the cementing position.

Stage cementing tool 15 comprises a mandrel 38 having upper end 40 and lower end 42. Mandrel 38 will be connected in casing string 5 in any manner known in the art. Mandrel 38 defines a central flow passage 44 therethrough and has a plurality of cement flow passages 46 in the wall 39 thereof. Cement flow passages 46 are longitudinally extending cement flow passages and have an upper end 48 and a lower end 50. Mandrel 38 has an outer surface 52 and an inner surface 54 which defines a central flow passage 44. A retaining seat 56 is fixed in mandrel 38.

Stage cementing tool 15 has a packer assembly 58 that is movable from an unset position 59 to a set position 60. In the described embodiment packer 58 is a compression set packer. Packer assembly 58 includes a packer element 62, a fixed wedge 64 that is fixed to mandrel 38 and a setting wedge 66 that is slidable on mandrel 38. A body lock ring 68 is positioned between setting wedge 66 and mandrel 38. Body lock ring 68 will prevent setting wedge 66 from moving upwardly on mandrel 38 once it has moved downwardly and urged the packer assembly 58 to its set position 60. Body lock rings of this type are well known in the art and act like a ratchet with teeth that will engage and coact with mandrel 38 to prevent unwanted upward movement on the mandrel of the setting wedge 66 after the packer 58 is set.

Stage cementing tool 15 includes a cementing valve 71. Cementing valve 71 comprises an opening sleeve 72 having outer surface 73, upper end 74 and lower end 76. A plurality of cement flow ports 78 are defined in a wall 80 of opening sleeve 72. In the embodiment described cement flow ports are fully open cement flow ports. A fully open flow port has no rupture disk or other barrier therein to prevent flow therethrough. Opening sleeve 72 is detachably connected to setting wedge 66 with shear pins 82 or other means known in the art. Opening sleeve 72 is connected at or near its lower end 76 to setting wedge 66. A lock ring 84 circumscribes mandrel 38 and extends from a groove therein into a groove 85 in opening sleeve 72. Lock ring 84 helps to hold opening sleeve 72 in a first or run-in position 86 of opening sleeve 72. The first or run-in position of opening sleeve 72 is the first or run-in position 30 of the stage cementing tool 15. As explained in more detail below, the opening sleeve 72 is movable to a second, or set position 88 which is the second or set position 32 of the stage cementing tool 15. The opening sleeve 72 is further movable to a third or cementing position of the opening sleeve 72 which is the third or cementing position 34 of the stage cementing tool 15. The opening sleeve stays in its third position 90 when the stage cementing tool 15 is moved to its fourth or completed position 36. Retaining seat 56 may have an upper end that has an anti-rotation profile that will coact with the lower end 76 of opening sleeve 72 to prevent relative rotation therebetween during a drill-out of the opening sleeve.

Figure 2:
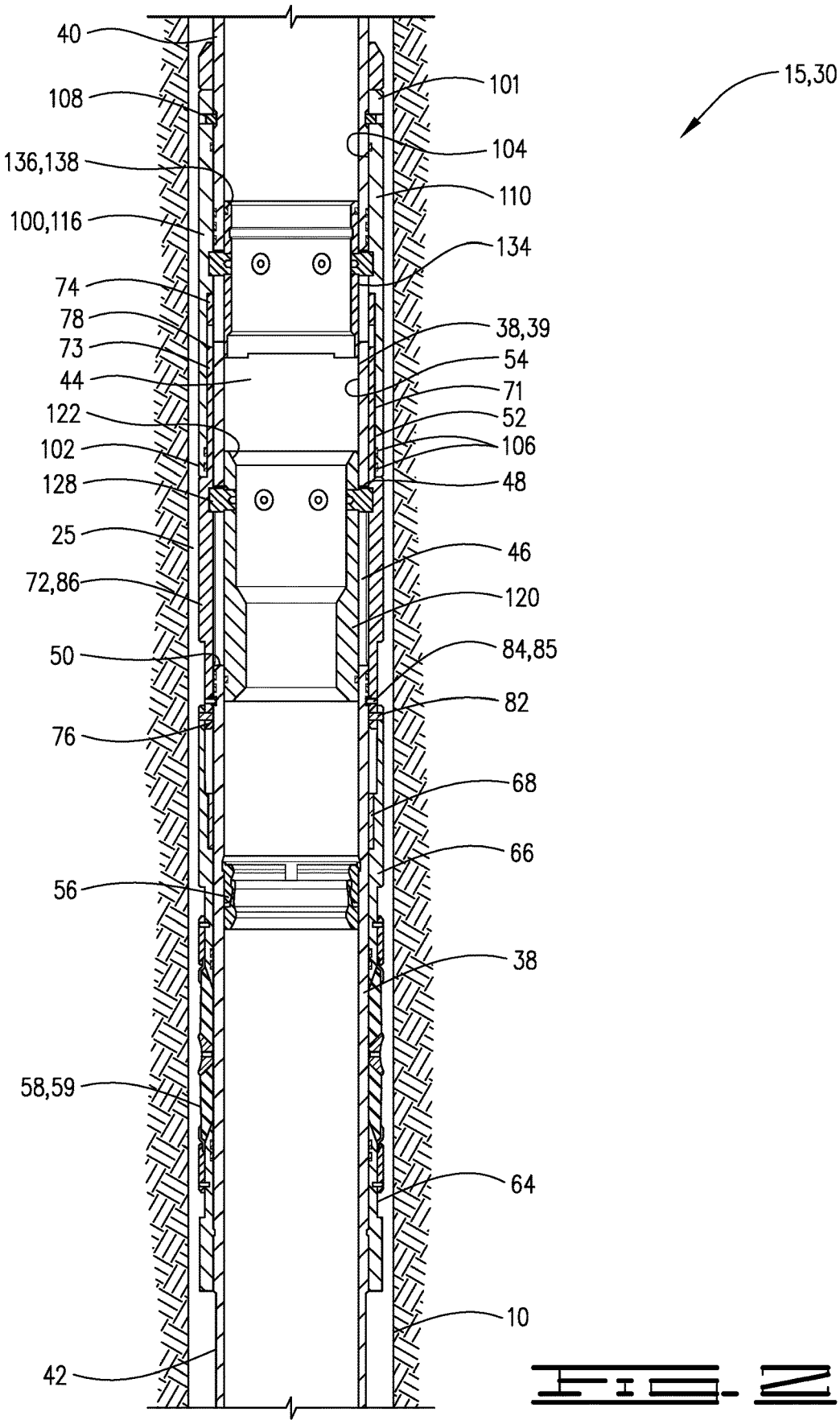
FIG. 2 is a cross section of the cementing tool in a run-in position.
Figure 3:
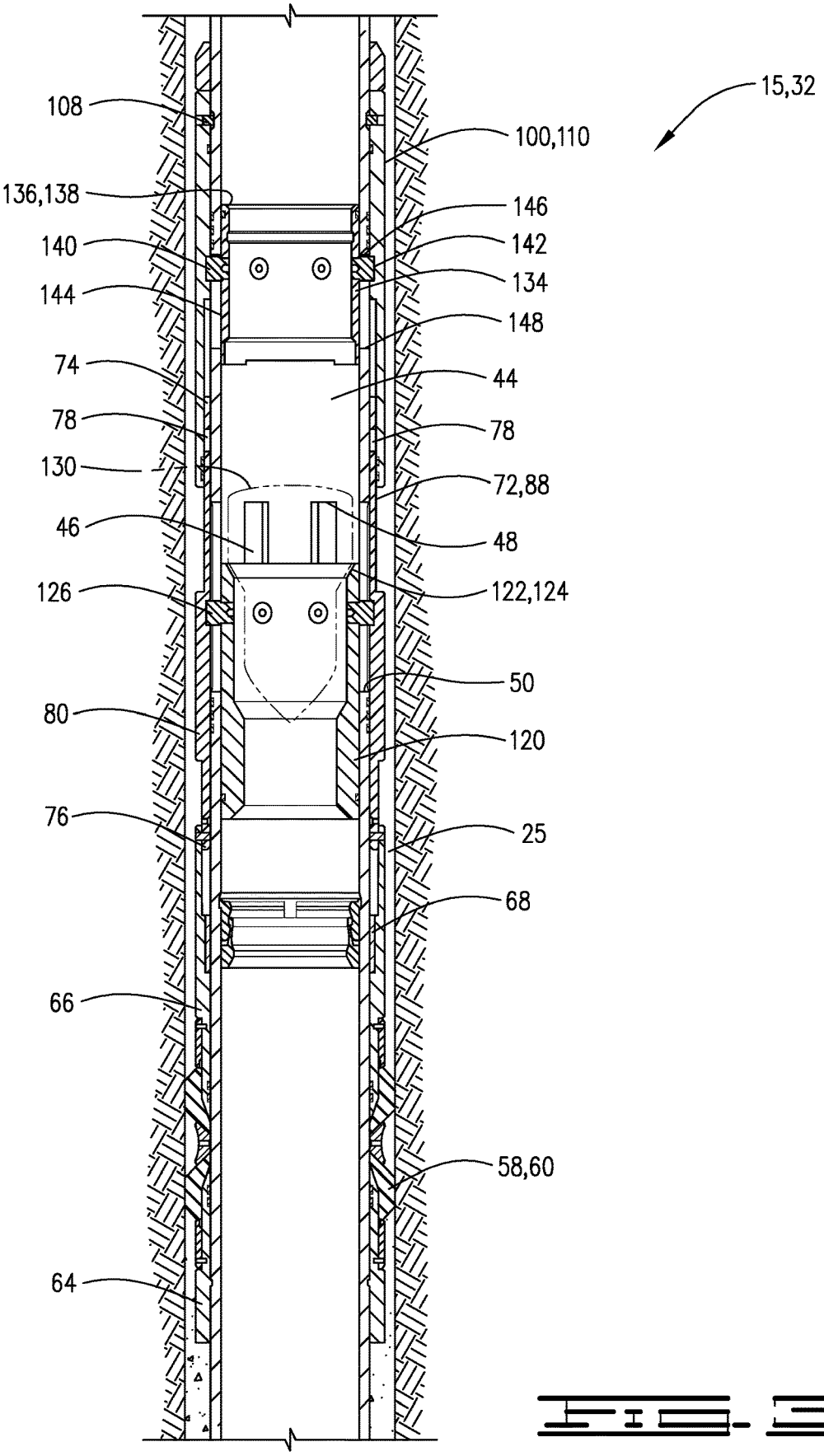
FIG. 3 is a cross section of the tool in a set position.

Cement valve 71 further comprises a closing sleeve 100 is detachably connected to mandrel 38. Once detached, closing sleeve 100 is slidable on mandrel 38. Closing sleeve 100 has upper end 101, lower end 102 and an inner surface 104. Closing sleeve 100 is detachably connected to mandrel 38 with shear pins 108 or other means known. Closing sleeve 100 has a plurality of O-ring seals 106 disposed in a groove therein that will sealingly engage outer surface 73 of opening sleeve 72. Cement flow ports 78 are sealingly trapped, or captured between closing sleeve 100 and mandrel 38 in both the run-in and the set positions of the opening sleeve 72 and the stage cementing tool 15. Closing sleeve 100 has a first position 110 which is shown in FIGS. 2 and 3. Closing sleeve 100 thus stays in its first position 110 in the run-in, set, and cementing positions 30, 32 and 34 of the stage cementing tool 15 which are the run-in, set and cementing positions 86, 88 and 90 of opening sleeve 72. Closing sleeve lower end 102 has an anti-rotation profile that will coact with the upper end 74 of opening sleeve 72 to prevent relative rotation therebetween during a drill-out of the opening sleeve 72.

Once cementing has been completed, the closing sleeve 100 will move to a second position 112 in which the closing sleeve 100 moves downwardly on mandrel 38 to once again cover cement flow ports 78 such that the cement flow ports are trapped between mandrel 38 and closing sleeve 100. This represents the fourth, or completed position of the cementing tool 15. As is evident from the drawings, opening sleeve 72 is telescopically movable relative to closing sleeve 100 and once detached, closing sleeve 100 is telescopically movable relative to opening sleeve 72. Thus, the opening sleeve 72 and closing sleeve 100 comprise a telescopic sleeve assembly 116.

Stage cementing tool 15 further comprises an opening seat 120 with an engagement surface 122 defined at an upper end 124 thereof. A plurality of drive pins 126 are connected to opening seat 120 by threading or otherwise and extend through cement flow passages 46 into bores 128 in opening sleeve 72. An opening plug 130 will be displaced downwardly through casing 5 until it engages opening seat 120. The opening plug 130 is shown in imaginary lines in the figures. As pressure is increased above the opening plug 130 the opening seat 120 will be moved downwardly in mandrel 38. Opening sleeve 72 is movable with opening seat 120 and will likewise move downwardly. Opening sleeve 72 will urge setting wedge 66 downwardly into packer element 62 and will urge packer element 62 radially outwardly so that it engages wellbore 10. Drive pins 126 are slidable in the longitudinally extending flow passages 46. Once the stage cementing tool 15 has been moved to its second position 32 in which the packer is set, pressure will continue to be applied above opening plug 130 until shear pins 82 have been broken and the opening sleeve 72 moves downwardly to its third position 90 which is the cementing position and is the cementing position of stage cementing tool 15. In the cementing position 34 of the cementing tool 15, which is the cementing position of the opening sleeve 72, cement flow ports 78 are exposed. In other words, cement flow ports 78 are no longer covered by closing sleeve 100. In the cementing position, the cement flow ports 78 are aligned with cement flow passages 46 in mandrel 38 and define a cement flow path 129 from central flow passage 44 to annulus 25.

A closing seat 134 is positioned in mandrel 38 above opening seat 120. Closing seat 134 has an engagement surface 136 at an upper end 138 thereof. A plurality of drive pins 140 are connected to closing seat 134. Drive pins 140 extend through mandrel 38 and into a plurality of bores 142 in closing sleeve 100. Drive pins 140 extend through slots 144 in mandrel 38 which have upper end 146 and lower end 148.

In operation, stage cementing tool 15 is lowered into wellbore 10 in casing string 5. A first, or previous stage cementing operation will occur once casing 5 is positioned in the wellbore 10 at the desired location. The first stage cementing is conducted in a manner known in the art which typically includes pumping cement downwardly through central flow passage 44 through a lower end of the casing which may have a float shoe thereon. FIG. 1 schematically shows the result of the first stage cementing. Once first stage cementing is complete, second stage cementing can occur through the stage cementing tool 15.

The stage cementing tool 15 is in the first, or run-in position until the first, or prior stage is cemented. Thereafter, opening plug 130 is displaced downwardly through casing 5 until it lands on engagement surface 122 of opening seat 120. Pressure thereabove is increased until sufficient pressure is applied to overcome lock ring 84, or other means that connect opening sleeve 72 to mandrel 38. Opening seat 120 moves downwardly in mandrel 38 and opening sleeve 72 will move downwardly on mandrel 38 with opening seat 120. Opening sleeve 72 is movable with opening seat 120 on mandrel 38 and will move downwardly with opening seat 120 as a result of the connection of the opening seat 120 with opening sleeve 72 with drive pins 126. Drive pins 126 are slidable in cement flow passages 46 and will slide downwardly therein.

Opening sleeve 72 will move downwardly from its first or run-in position 86 shown in FIG. 2 to the second or set position 88 shown in FIG. 3 in which packer 58 is urged outwardly and is engaged with wellbore 10. The set position of the opening sleeve 72 and packer 58 is the set position 32 of stage cementing tool 15. The set position 88 of the opening sleeve 72 is an intermediate position between the run-in and cementing positions of the opening sleeve 72. In the embodiment described, cement flow ports 78 are sealingly trapped between closing sleeve 100 and mandrel 38 in both the run-in and set positions of the opening sleeve and the stage cementing tool 15. Once stage cementing tool 15 has been set, pressure is continuously applied in central flow passage 44 to a predetermined pressure at which shear pins 82 will break. Once shear pins 82 break, opening sleeve 72 will move downwardly to the third or cementing position of the opening sleeve 72 and the stage cementing tool 15. In the cementing position of the opening sleeve 72 and stage cementing tool 15 packer 58 remains set, and cement flow ports 78 are aligned with cement flow passages 46 to define cement flow path 129.

Figure 4:
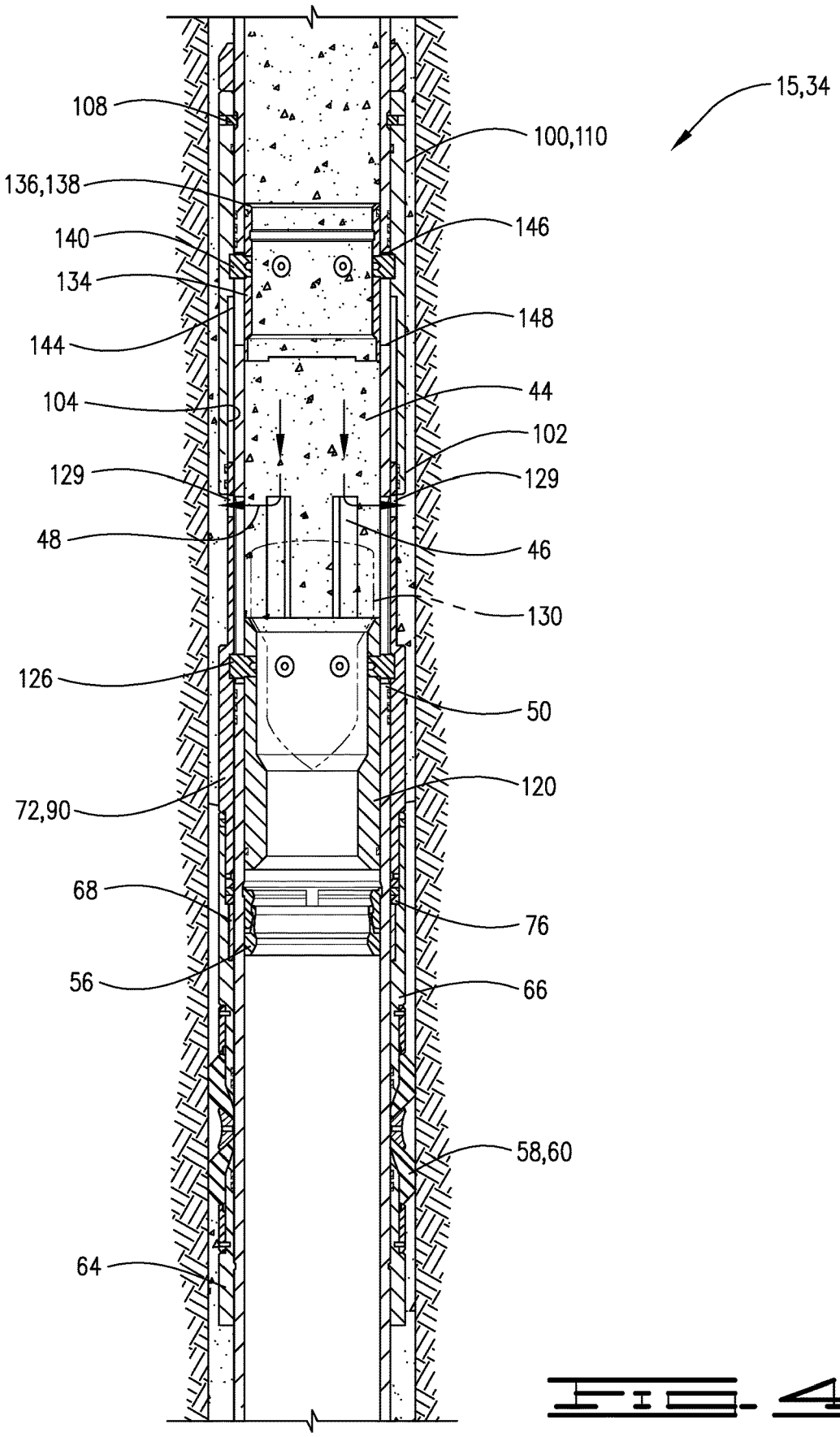
FIG. 4 is a cross section of the tool in a cementing position.
Figure 5:
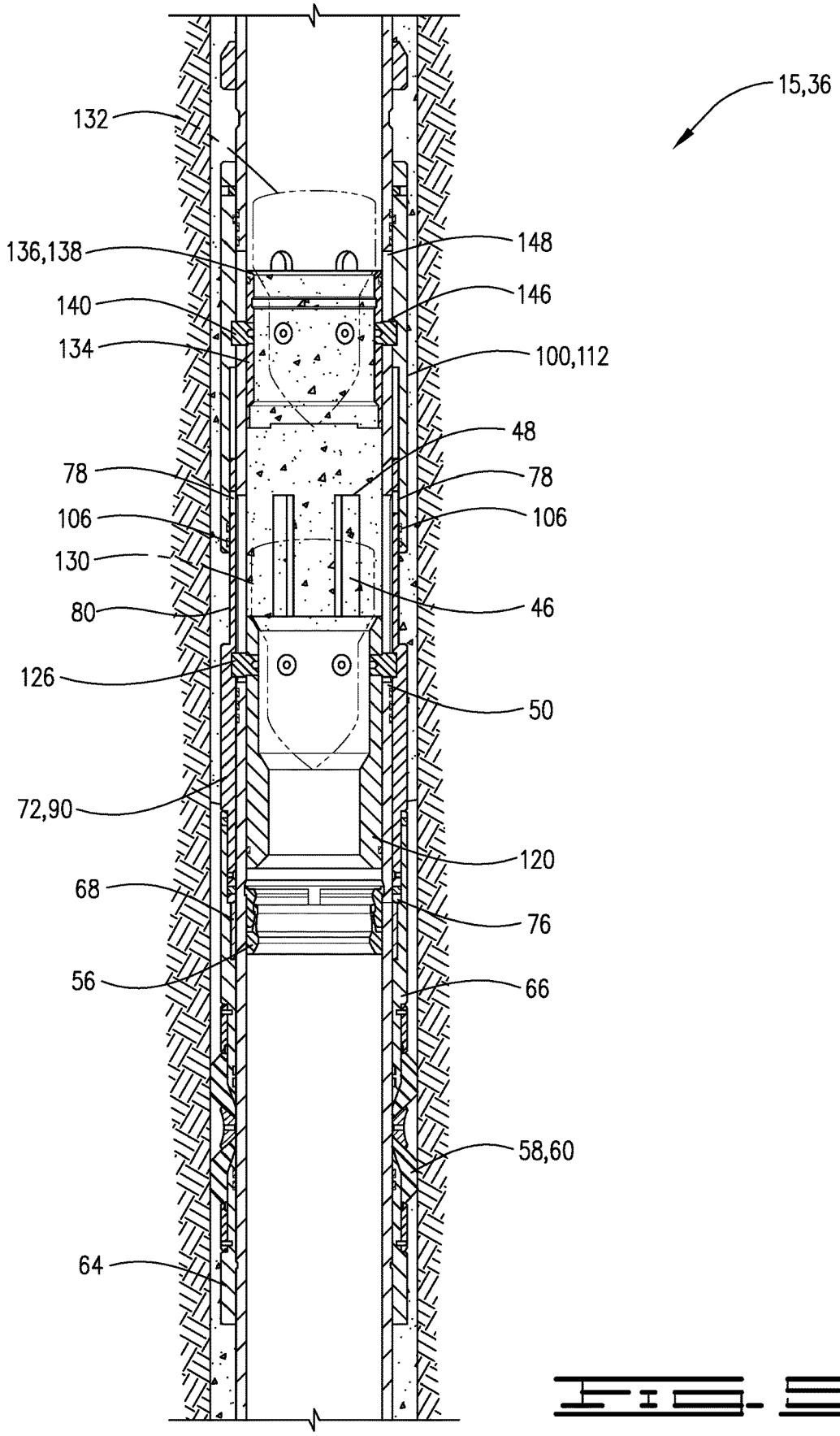
FIG. 5 is a cross section of the tool in a closed or completed position.

Once the stage cementing tool 15 is in the cementing position shown in FIG. 4, cement may be delivered therethrough and will pass through the cement flow path 129. A closing plug 132 will be placed in casing 5 behind a trailing edge of the cement. Closing plug 132 is shown in imaginary lines in the figures. Closing plug 132 will land on closing seat 134 and pressure will be increased until shear pins 108 break. Once shear pins 108 have broken closing seat 134 will move downwardly. Drive pins 140 will slide downwardly from the upper end 146 of slots 144 toward lower end 148. Because closing sleeve 100 is connected to closing seat 134, closing seat 134 cannot move until shear pins 108 break, and closing sleeve 100 will move downwardly as closing seat 134 moves downwardly in mandrel 38. Drive pins 140 will land at lower end 148 of slots 144 which will stop the downward movement of closing seat 134 and closing sleeve 100. In the second position of the closing sleeve 100, stage cementing tool 15 is in its fourth or completed position. In that position, cement flow ports 78 are once again sealingly trapped between closing sleeve 100 and mandrel 38 which prevents flow from central flow passage 44 through cement flow path 129 into annulus 25.

Example Embodiments

Embodiment 1: A stage cementing tool for use in a wellbore comprising a mandrel defining a central flow passage therethrough and a plurality of cementing passages in a wall thereof. A compression set packer is disposed about the mandrel and movable from an unset to a set position. A closing sleeve is detachably connected to and movable relative to the mandrel from a first position to a second position. An opening sleeve defining a plurality of fully open cement flow ports therethrough is telescopically movable relative to the closing sleeve and movable relative to the mandrel from a first position to a second position to move the packer to the set position, and is movable from the second position to a third position on the mandrel in which the cement ports and cementing passages are in communication to define a cement flow path between the central flow passage and an annulus defined by the stage cementing tool and the wellbore.

Embodiment 2: The stage cementing tool of embodiment 1 further comprising an opening seat disposed in the mandrel; and a plurality of drive pins connected to the opening seat and extending through the mandrel into the opening sleeve, the opening seat movable in the mandrel and operable to move the opening sleeve from the first to the second position and from the second position to the third position of the opening sleeve.

Embodiment 3: The tool of any of embodiments 1 and 2, the closing sleeve covering the cement flow ports in the second position of the closing sleeve to prevent communication between the central flow passage and the annulus through the cement flow path.

Embodiment 4: The tool of any of embodiments 1-3, further comprising a closing seat disposed in the mandrel and movable therein, the closing seat connected to the closing sleeve and operable to move the closing sleeve from the first to the second position thereof.

Embodiment 5: The tool of any of embodiments 1-4, the cement flow ports being sealingly captured between the closing sleeve and the mandrel in the first position of the opening sleeve and the first position of the closing sleeve.

Embodiment 6: The tool of any of embodiments 1-5, the cement flow ports being trapped between the closing sleeve and the mandrel in the third position of the opening sleeve and the second position of the closing sleeve.

Embodiment 7: The tool of any of embodiments 1-6, further comprising an opening plug sized to pass through the closing seat and land on the opening seat, the opening seat movable in the mandrel to move the opening sleeve from the first to the second and the second to the third positions upon the application of pressure above the opening plug in the stage cementing tool.

Embodiment 8: A stage cementing tool for use in a wellbore comprising a mandrel defining a central flow passage and a plurality of cement flow passages in a wall thereof; a compression set packer on the mandrel and movable from an unset to a set position; an opening sleeve disposed about the mandrel, the opening sleeve defining a plurality of cement flow ports therethrough and movable on the mandrel to move the packer and the stage cementing tool to the set position, and movable further on the mandrel to a cementing position of the stage cementing tool in which the cement flow ports align with the cement flow passages to define a cement flow path from the central flow passage to an annulus defined by the wellbore and the stage cementing tool; and a closing sleeve disposed about the mandrel, the cement flow ports being sealingly trapped between the closing sleeve and the mandrel prior to the opening sleeve moving relative to the mandrel.

Embodiment 9: The stage cementing tool of embodiment 8 further comprising an opening seat disposed in the housing; and a plurality of drive pins extending through the cement flow passages in the mandrel to connect the opening seat to the opening sleeve, the opening sleeve movable with the opening seat.

Embodiment 10: The stage cementing tool of any of embodiments 8-9 the packer comprising a packer element and a setting wedge slidably disposed about the mandrel, the opening sleeve detachably connected to the setting wedge.

Embodiment 11: The stage cementing tool of embodiment 10, the cement flow passages comprising longitudinally extending slots in which the drive pins travel downwardly to move the stage cementing tool to the set position, the opening sleeve being detachable from the setting wedge after the packer is in the set position to move downwardly on the mandrel and move the stage cementing tool to the cementing position.

Embodiment 12: The stage cementing tool of any of embodiments 8-11, the closing sleeve detachably connected to the mandrel and movable thereon to cover the cement flow ports and prevent communication therethrough after the opening sleeve has moved to the cementing position and a desired amount of cement has been displaced into the annulus.

Embodiment 13: The stage cementing tool of any of embodiments 8-12 further comprising a closing seat disposed in the mandrel; and a plurality of closing sleeve drive pins extending from the closing seat through the mandrel and into the closing sleeve.

Embodiment 14: The stage cementing tool of embodiment 8 further comprising an opening seat disposed in the mandrel, the opening sleeve being connected to the opening seat and movable therewith; and a closing seat disposed in the mandrel, the closing sleeve being connected to the closing seat and movable therewith.

Embodiment 15: A stage cementing tool for use in a wellbore comprising a mandrel defining a central flow passage and a plurality of cement passages in a wall thereof; a compression set packer; a packer setting wedge slidably disposed about the mandrel and movable thereon; an opening sleeve defining a plurality of cement flow ports therethrough detachably connected to the setting wedge and slidable on the mandrel to a second position to move the setting wedge into the packer and urge the packer from an unset to a set position; and an opening seat disposed in the mandrel and connected to the opening sleeve, the opening sleeve movable with the opening seat from a first position on the mandrel to the second position to move the packer and the stage cementing tool to the set position, the opening sleeve movable further on the mandrel to a third position in which the cement passages and cement flow ports form a cement flow path from the central flow passage to an annulus defined by the stage cementing tool and the wellbore.

Embodiment 16: The tool of embodiment 15, further comprising a closing sleeve detachably connected to the mandrel, the opening sleeve telescopically movable relative to the closing sleeve, the cement flow ports sealingly captured between the mandrel and the closing sleeve in the first position of the opening sleeve.

Embodiment 17: The tool of any of embodiments 15-16 further comprising a closing seat disposed in the mandrel and connected to the closing sleeve, the closing sleeve movable with the closing seat from a first position of the closing sleeve to a second position of the closing sleeve, the closing sleeve covering the cement flow ports in the second position of the closing sleeve to prevent flow therethrough after the opening sleeve has moved to the third position and cementing has been completed.

Embodiment 18: The tool of any of embodiments 15-17, the cement flow passages comprising longitudinal slots, further comprising drive pins connected to the opening seat and the opening sleeve, the drive pins extending through and slidable in the longitudinal slots.

Embodiment 19: The tool of any of claims 15-18, further comprising an opening plug engaged with the opening seat, the opening seat movable in the mandrel to move the opening sleeve from the first to the second, and the second to the third position on the application of pressure in the central flow passage above the landed opening plug.

Embodiment 20: The tool of any of claims 15-19 further comprising a closing sleeve detachably connected to the mandrel and movable on the mandrel to sealingly trap the cement flow ports between the mandrel and the closing sleeve after the opening sleeve has moved to the third position.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A stage cementing tool for use in a wellbore comprising:

a mandrel defining a central flow passage therethrough and a plurality of cementing passages in a wall thereof;

a compression set packer disposed about the mandrel and movable from an unset to a set position;

a closing sleeve detachably connected to and movable relative to the mandrel from a first position to a second position of the closing sleeve;

an opening sleeve defining a plurality of fully open cement flow ports therethrough, the opening sleeve telescopically movable relative to the closing sleeve and movable relative to the mandrel from a first position to a second position to move the packer to the set position, and movable from the second position to a third position on the mandrel in which the cement ports and cementing passages are in communication to define a cement flow path between the central flow passage and an annulus defined by the stage cementing tool and the wellbore;

an opening seat disposed in the mandrel; and a plurality of drive pins connected to the opening seat and extending through the mandrel into the opening sleeve, the opening seat movable in the mandrel and operable to move the opening sleeve from the first to the second position and from the second position to the third position.

2. The stage cementing tool of claim 1, the closing sleeve covering the cement flow ports in the second position of the closing sleeve to prevent communication between the central flow passage and the annulus through the cement flow path.

3. The stage cementing tool of claim 2, further comprising a closing seat disposed in the mandrel and movable therein, the closing seat connected to the closing sleeve and operable to move the closing sleeve from the first to the second position thereof.

4. The stage cementing tool of claim 1, the cement flow ports being sealingly captured between the closing sleeve and the mandrel in the first position of the opening sleeve and the first position of the closing sleeve.

5. The stage cementing tool of claim 1, the cement flow ports being trapped between the closing sleeve and the mandrel in the third position of the opening sleeve and the second position of the closing sleeve.

6. The stage cementing tool of claim 3 further comprising an opening plug sized to pass through the closing seat and land on the opening seat, the opening seat movable in the mandrel to move the opening sleeve from the first to the second and the second to the third positions upon the application of pressure above the opening plug in the stage cementing tool.

7. A stage cementing tool for use in a wellbore comprising:

a mandrel defining a central flow passage and a plurality of cement flow passages in a wall thereof;

a compression set packer on the mandrel and movable from an unset to a set position;

an opening sleeve disposed about the mandrel, the opening sleeve defining a plurality of cement flow ports therethrough and movable on the mandrel to move the packer and the stage cementing tool to the set position, and movable further on the mandrel to a cementing position of the stage cementing tool in which the cement flow ports align with the cement flow passages to define a cement flow path from the central flow passage to an annulus defined by the wellbore and the stage cementing tool; and a closing sleeve disposed about the mandrel, the cement flow ports being sealingly trapped between the closing sleeve and the mandrel prior to the opening sleeve moving relative to the mandrel.

8. The tool of claim 7 further comprising:

an opening seat disposed in the mandrel; and a plurality of drive pins extending through the cement flow passages in the mandrel to connect the opening seat to the opening sleeve, the opening sleeve movable with the opening seat.

9. The stage cementing tool of claim 8, the packer comprising a packer element and a setting wedge slidably disposed about the mandrel, the opening sleeve detachably connected to the setting wedge.

10. The stage cementing tool of claim 9, the cement flow passages comprising longitudinally extending slots in which the drive pins travel downwardly to move the stage cementing tool to the set position, the opening sleeve being detachable from the setting wedge after the packer is in the set position to move downwardly on the mandrel and move the stage cementing tool to the cementing position.

11. The stage cementing tool of claim 7, the closing sleeve detachably connected to the mandrel and movable thereon to cover the cement flow ports and prevent communication therethrough after the opening sleeve has moved to the cementing position and a desired amount of cement has been displaced into the annulus.

12. The stage cementing tool of claim 11, further comprising:

a closing seat disposed in the mandrel; and a plurality of closing sleeve drive pins extending from the closing seat through the mandrel and into the closing sleeve, the closing sleeve movable with the closing seat.

13. The stage cementing tool of claim 7 further comprising:

an opening seat disposed in the mandrel, the opening sleeve being connected to the opening seat and movable therewith; and a closing seat disposed in the mandrel, the closing sleeve being connected to the closing seat and movable therewith.

14. A stage cementing tool for use in a wellbore comprising:

a mandrel defining a central flow passage and a plurality of cement passages in a wall thereof;

a compression set packer;

a packer setting wedge slidably disposed about the mandrel;

an opening sleeve defining a plurality of cement flow ports therethrough detachably connected to the setting wedge and slidable on the mandrel to a second position to move the setting wedge into the compression set packer and urge the compression set packer from an unset to a set position; and an opening seat disposed in the mandrel and connected to the opening sleeve, the opening sleeve movable with the opening seat from a first position on the mandrel to the second position to move the packer and the stage cementing tool to the set position, the opening sleeve movable further on the mandrel to a third position in which the cement passages and cement flow ports form a cement flow path from the central flow passage to an annulus defined by the stage cementing tool and the wellbore.

15. The stage cementing tool of claim 14, further comprising a closing sleeve detachably connected to the mandrel, the opening sleeve telescopically movable relative to the closing sleeve, the cement flow ports sealingly captured between the mandrel and the closing sleeve in the first position of the opening sleeve.

16. The stage cementing tool of claim 15 further comprising a closing seat disposed in the mandrel and connected to the closing sleeve, the closing sleeve movable with the closing seat from a first position of the closing sleeve to a second position of the closing sleeve, the closing sleeve covering the cement flow ports in the second position of the closing sleeve to prevent flow therethrough after the opening sleeve has moved to the third position and cementing has been completed.

17. The stage cementing tool of claim 15, the cement flow passages comprising longitudinal slots, further comprising drive pins connected to the opening seat and the opening sleeve, the drive pins extending through and slidable in the longitudinal slots.

18. The stage cementing tool of claim 14, further comprising an opening plug engaged with the opening seat, the opening seat movable in the mandrel to move the opening sleeve from the first to the set, and the set to the cementing position on the application of pressure in the central flow passage above the landed opening plug.

19. The stage cementing tool of claim 14 further comprising a closing sleeve detachably connected to the mandrel and movable on the mandrel to sealingly trap the cement flow ports between the mandrel and the closing sleeve after the opening sleeve has moved to the cementing position.

* * * * *